US006878031B2

(12) United States Patent
Romyn

(10) Patent No.: US 6,878,031 B2
(45) Date of Patent: Apr. 12, 2005

(54) TOY

(76) Inventor: Michael Petrus Romyn, 24 Hayes Ct., Gidgegannup WA (AU), 6083

( * ) Notice: Subject to any disclaimer, the term of this patent is extended or adjusted under 35 U.S.C. 154(b) by 0 days.

(21) Appl. No.: 10/221,256

(22) PCT Filed: Mar. 12, 2001

(86) PCT No.: PCT/AU01/00270

§ 371 (c)(1),
(2), (4) Date: Sep. 10, 2002

(87) PCT Pub. No.: WO01/66207

PCT Pub. Date: Sep. 13, 2001

(65) Prior Publication Data

US 2003/0060118 A1 Mar. 27, 2003

(30) Foreign Application Priority Data

Mar. 10, 2000 (AU) ..... PQ6163

(51) Int. Cl.[7] ..... A63H 17/00
(52) U.S. Cl. ..... 446/93
(58) Field of Search ..... 446/69, 85, 87, 446/93, 94, 95, 97, 99, 100, 153, 230

(56) References Cited

U.S. PATENT DOCUMENTS

| | | | | | |
|---|---|---|---|---|---|
| 3,996,692 | A | * | 12/1976 | Daenen | 446/94 |
| 4,184,285 | A | * | 1/1980 | Arnau Pibet | 446/93 |
| 4,723,930 | A | * | 2/1988 | Freese et al. | 446/93 |
| 5,743,779 | A | * | 4/1998 | Nielsen | 446/93 |
| 6,443,797 | B1 | * | 9/2002 | Liu | 446/93 |

FOREIGN PATENT DOCUMENTS

| | | | |
|---|---|---|---|
| GB | 2192555 | | 1/1988 |
| GB | 2212069 | * | 7/1989 |
| GB | 2333718 | | 8/1999 |

* cited by examiner

*Primary Examiner*—Jacob K. Ackun Jr.
(74) *Attorney, Agent, or Firm*—Michael Best & Friedrich LLP

(57) ABSTRACT

A toy comprising a plurality of removable members, each member having a predetermined shape, such that the members, when assembled in a predetermined order, form the outer shape of the toy, each member also having a plurality of removable elements of a predetermined shape that are insertable into a correspondingly shaped void in the member, whereby the toy may be assembled with or without the elements being within their corresponding members.

19 Claims, 8 Drawing Sheets

TOY

FIELD OF THE INVENTION

The present invention relates to a toy. In particular, although not exclusively, the present invention relates to a jigsaw/assembly toy.

BACKGROUND OF THE INVENTION

Australian patent No. 598267 to Dart Industries Inc. discloses an ark toy comprising an hull element, a deck element and a cabin element which releasably interlock together to form the ark. As seen in FIG. 1 of AU 598267 animal shaped figurines may be placed on the deck element and within the cabin element.

Australian patent No. 576463 discloses a toy with a base member having a generally spherically shaped bottom surface upon which may be stacked a plurality of other members. The plurality of other members are aligned by a centrally positioned post means.

An objection of the present invention is to provide an alternate form of jigsaw/assembly toy.

SUMMARY OF THE INVENTION

According to the present invention there is a toy comprising a plurality of removable members, each member having a predetermined shape, such that the members, when assembled in a predetermined order, form the outer shape of the toy, each member also having a plurality of removable elements of a predetermined shape that are insertable into a correspondingly shaped void in the member, whereby the toy may be assembled with or without the elements being within their corresponding members.

Preferably, the removable members form horizontal and/or vertical layers of the assembled toy. Preferably, each removable member is substantially planar and adapted to be layered with at least one of the other removable members.

Preferably, each element only fits in a respective correspondingly shaped void within one of the members.

Preferably, the toy further includes an interconnection member for connecting and holding together the members when the toy is assembled.

Preferably, a first set of members are horizontally layered. Preferably, a second set of members are vertically layered.

Preferably, the elements are tapered and the correspondingly shaped void is also tapered so as to receive the element in one direction but not allow it to pass through the member.

In one embodiment, the toy is in the shape of a boat when assembled, with the first set of members forming a hull. More preferably, the second set of the members form a cabin on a deck of the boat. More preferably still, the interconnecting member forms the keel of the boat. Preferably, each element is in the shape of an animal. More preferably, the animals are in pairs.

In a second embodiment, the toy is in the shape of a train when assembled, with the members being horizontally layered to form at least a locomotive portion of the train. Each element is in the shape of or illustratively represents a person on the train, such as a train drive, an engineer, or a conductor. Alternatively, each element is in the shape of or illustrates a different type of train.

In other embodiments the toy is in the shape of: a car with each element representing passengers in the car and/or different types of car, such as different vintages of car; a truck where each element represents a different type of truck; a ship where each element represents a different type of ship; or a human body where each element represents a body part or organ.

DETAILED DESCRIPTION OF THE INVENTION

In order to provide a better understanding, a preferred embodiment of the present invention will now be described in greater detail, by way of example only, with reference to the accompanying drawings in which.

Figure 1:
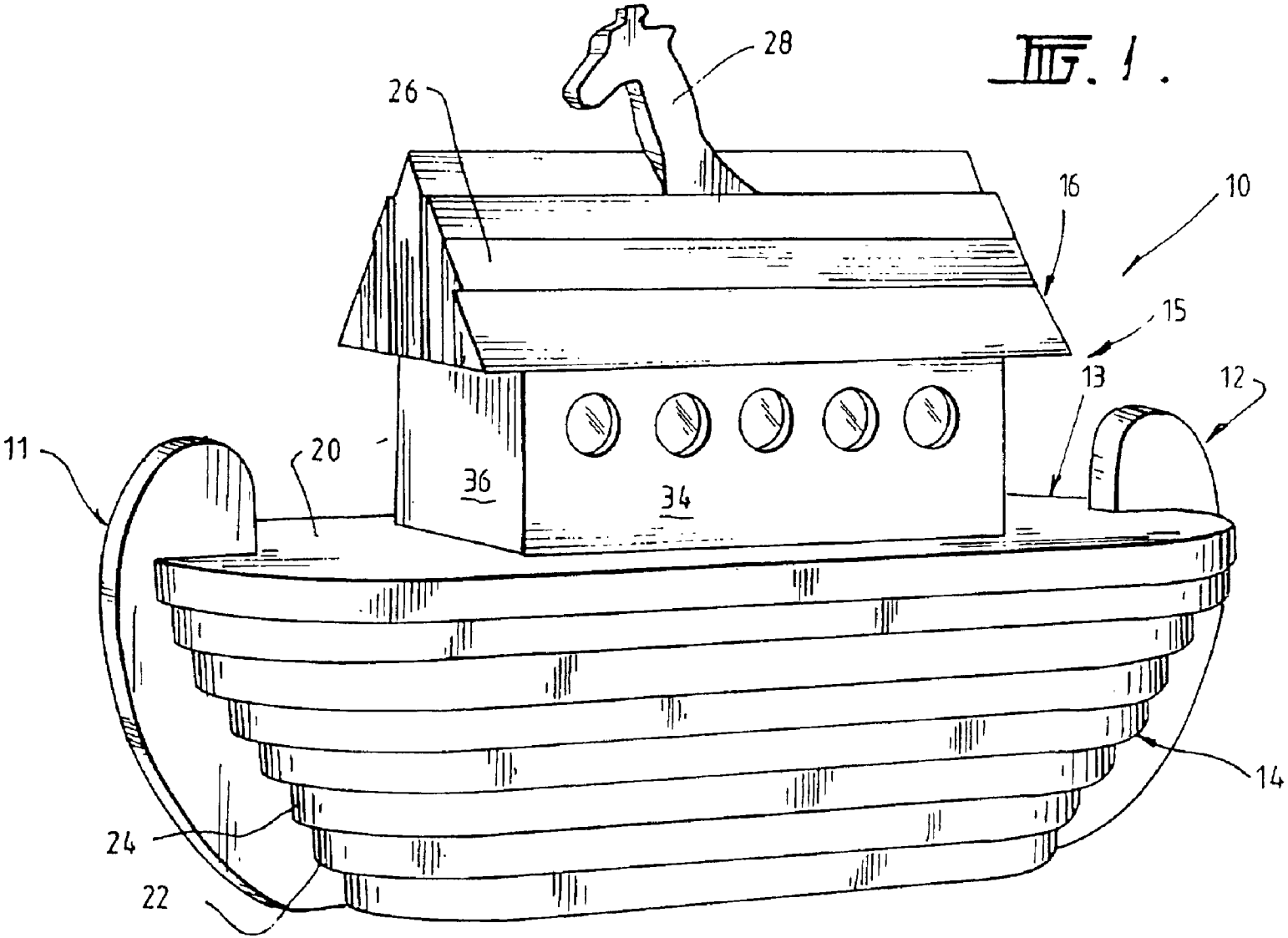
FIG. 1 is an upper perspective view of a preferred embodiment of the present invention.

Referring to FIG. 1, there is shown a Noah's ark toy 10 which includes a hull portion 11, a deck portion 13 and a cabin portion 15. The hull portion 11 includes a connection member 12 and a plurality of horizontally planar members 14 that engage with the connection member 12. Each of the horizontal planar members 14 are of an individual shape so that when they are layered in the correct order and engaged with the connection member 12 they form the hull portion 11. The top most horizontal planar member 20 forms the deck portion 13.

Figure 2:
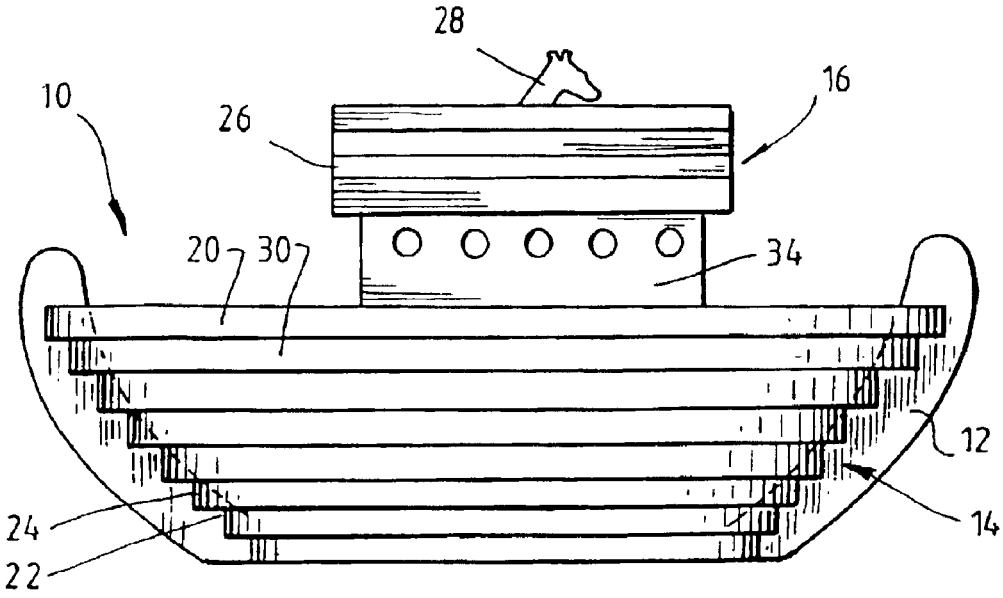
FIG. 2 is a side elevation of the invention of FIG. 1.

As can be seen more clearly in FIG. 2, each of the horizontal planar members are larger than the horizontal planar member beneath it. Thus, the hull portion 11 is stepped and generally forms a boat hull shape. Horizontal planar members 22, 24 and 30 are indicated for reasons explained below.

Figure 3:
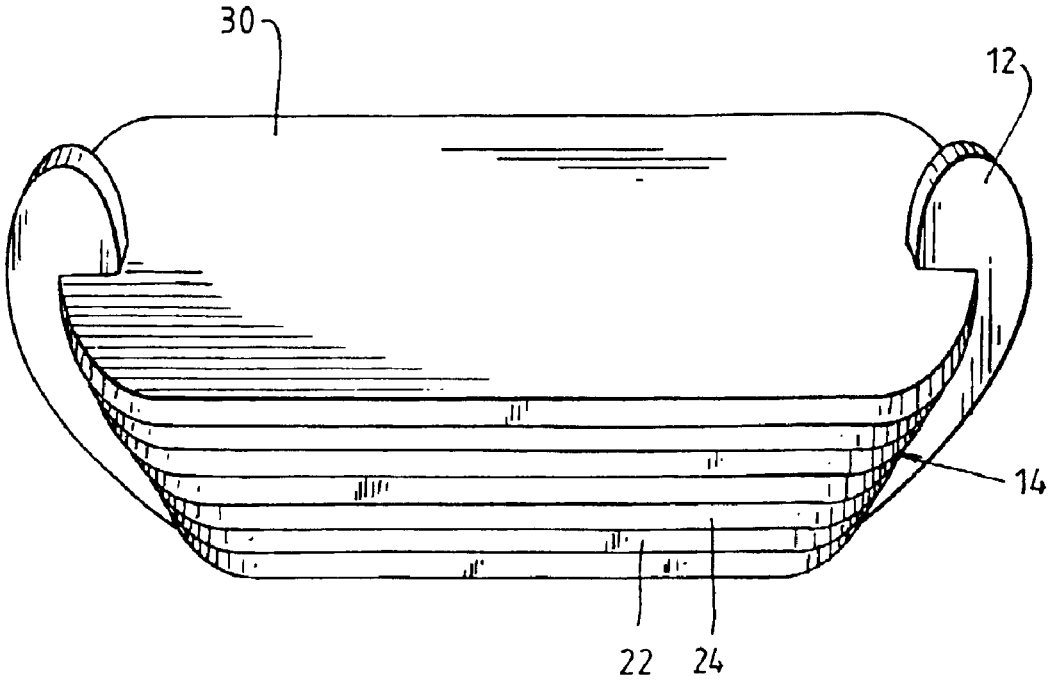
FIG. 3 is an upper perspective view of a first set of members forming a hull of the present invention.
Figure 6:
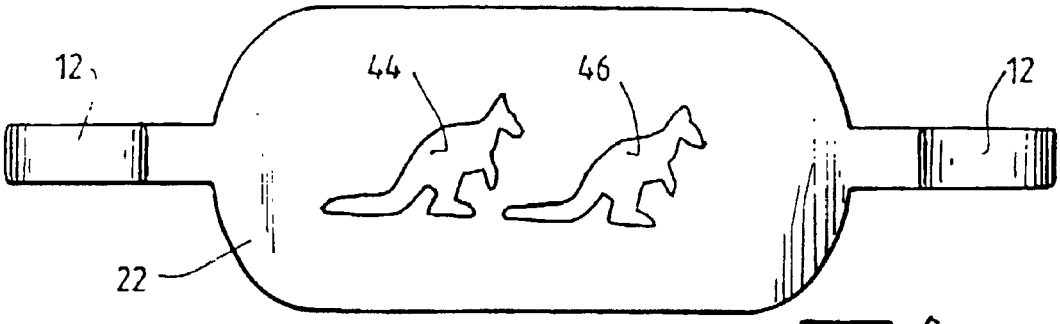
FIG. 6 is a top view of an interconnection member.

Referring to FIG. 6, it can be seen that horizontal planar member 22 is integral with interconnection member 12. Referring back to FIG. 2, planar member 24 rests on horizontal planar member 22. Other planar members rest one upon another to form the layers of the hull portion 11 up until planar member 30 which is also shown in FIG. 3. Upon planar member 30, is deck member 20.

Figure 5:
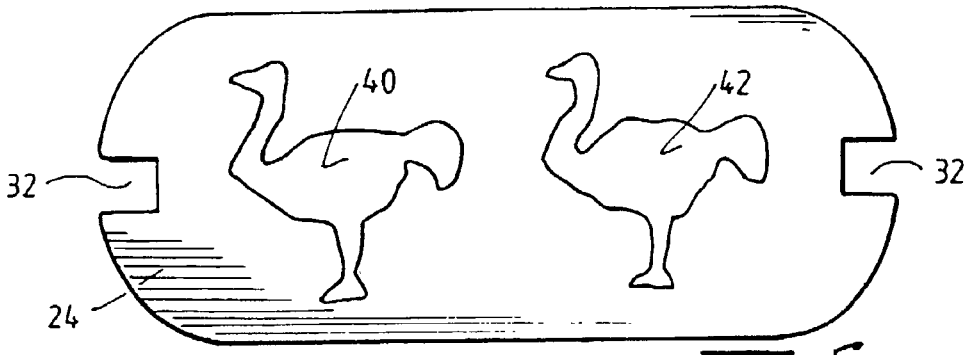
FIG. 5 is a top view of a horizontal removable member.

As best seen in FIG. 5, the planar members are elongate and have a cut-out 32 at each end. The cut-outs 32 allow the connection member 12 to be received within the cut-out 32 thereby providing coupling of each of the planar members with the interconnection member 12. Each of the planar members 14 may be removed simply by raising them up and away from interconnection member 12. Interconnection member 12 is curved so that planar members of increasing size may be coupled to it but may also be easily removed by lifting them up and away.

As can be seen in FIGS. 5 and 6, the horizontal planar members have animal shaped voids 40, 42, 44 and 46. Each void is able to receive a correspondingly shaped animal insert that fits within the void. The voids are tapered (not shown) so that when the animal figure is inserted into the respective void it will not pass all the way through.

The animal inserts are also correspondingly tapered so that they have a snug fit in the respective void.

Figure 4:
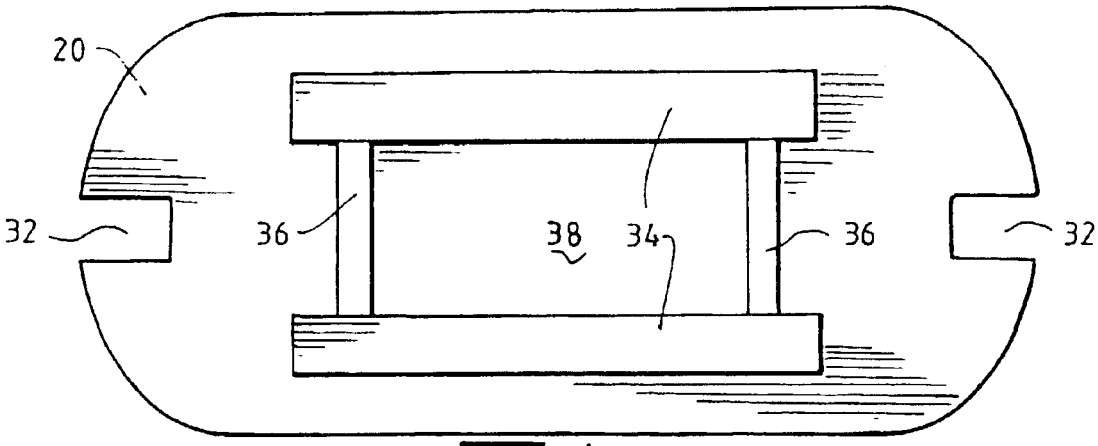
FIG. 4 is a top view of a deck member of the present invention.

Referring to FIG. 4, the deck member 20 does not include the animal shaped voids. Projecting upwardly from the member 20 are the outer walls of the cabin portion 15. These include side walls 34 and end walls 36. The walls define a space 38 within which horizontal planar members 16 are inserted.

Referring to FIG. 1, it can be seen that the vertical planar members 16 fit within the cabin walls to form the roof of the cabin portion.

Figure 7:
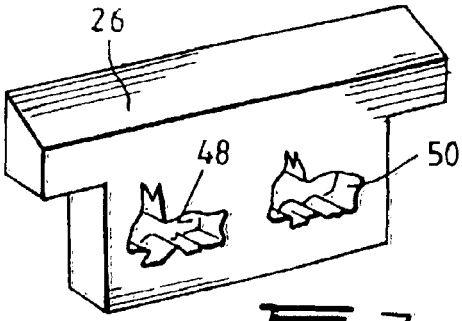
FIG. 7 is an upper perspective view of a vertical removable member.
Figure 8:
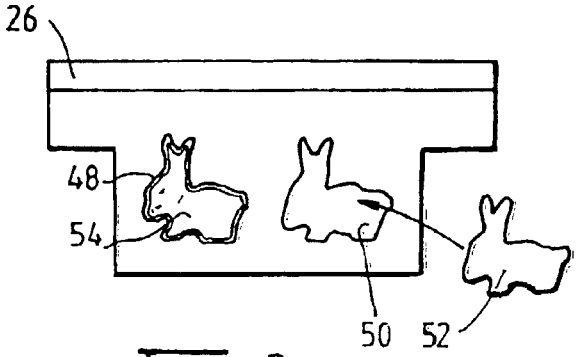
FIG. 8 is a front view of the vertical removable member of FIG. 7 with one removable element in the member and another removable element outside the member.

Referring to FIGS. 7 and 8, there is shown one of the vertical planar members 26 which also has voids of the shape of animals, in this case rabbits. Rabbit shaped inserts 52 and 54 fit within the voids 48 and 50. In FIG. 8 the rabbit insert 54 is in the void 48 and rabbit insert 52 is outside the void 50 and can be inserted as shown by the arrow. As seen in FIGS. 1 and 2, one of the animal inserts 28 in the form of a giraffe has its head projecting from the roof of the cabin 16.

Figure 9:
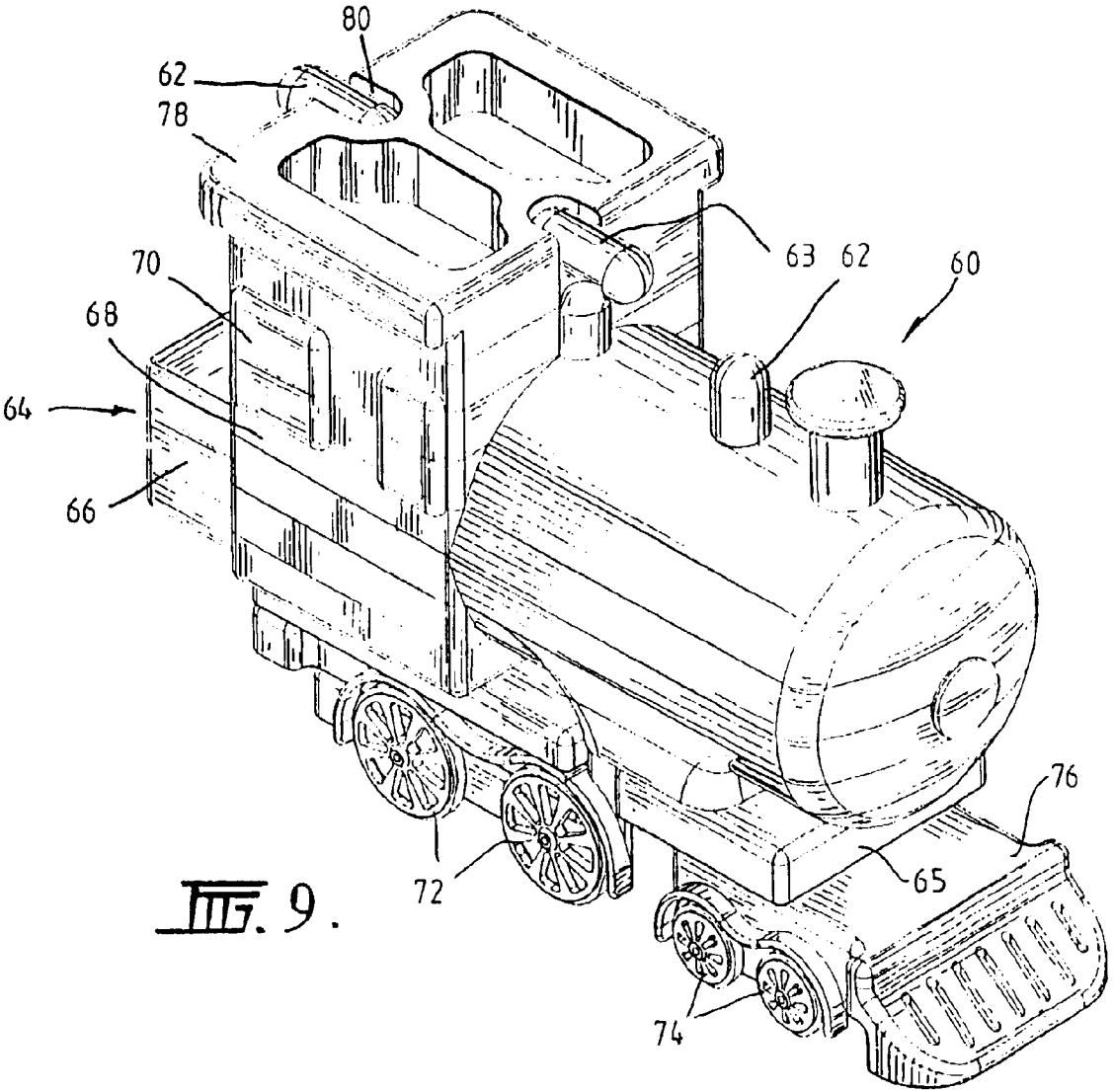
FIG. 9 is an upper perspective view of an alternative preferred embodiment of the present invention.

Referring to FIG. 9, there is shown an alternative toy train 60 in the shape of a steam locomotive engine. The locomotive 60 includes a connecting member 61 and a plurality of horizontal planar members 64 that engage with the connection member 61. Each of the horizontal planar members 64 are of an individual shape so that when layered in the correct order and engaged with the connection member 61 they form the body of the locomotive engine 60.

Figure 10:
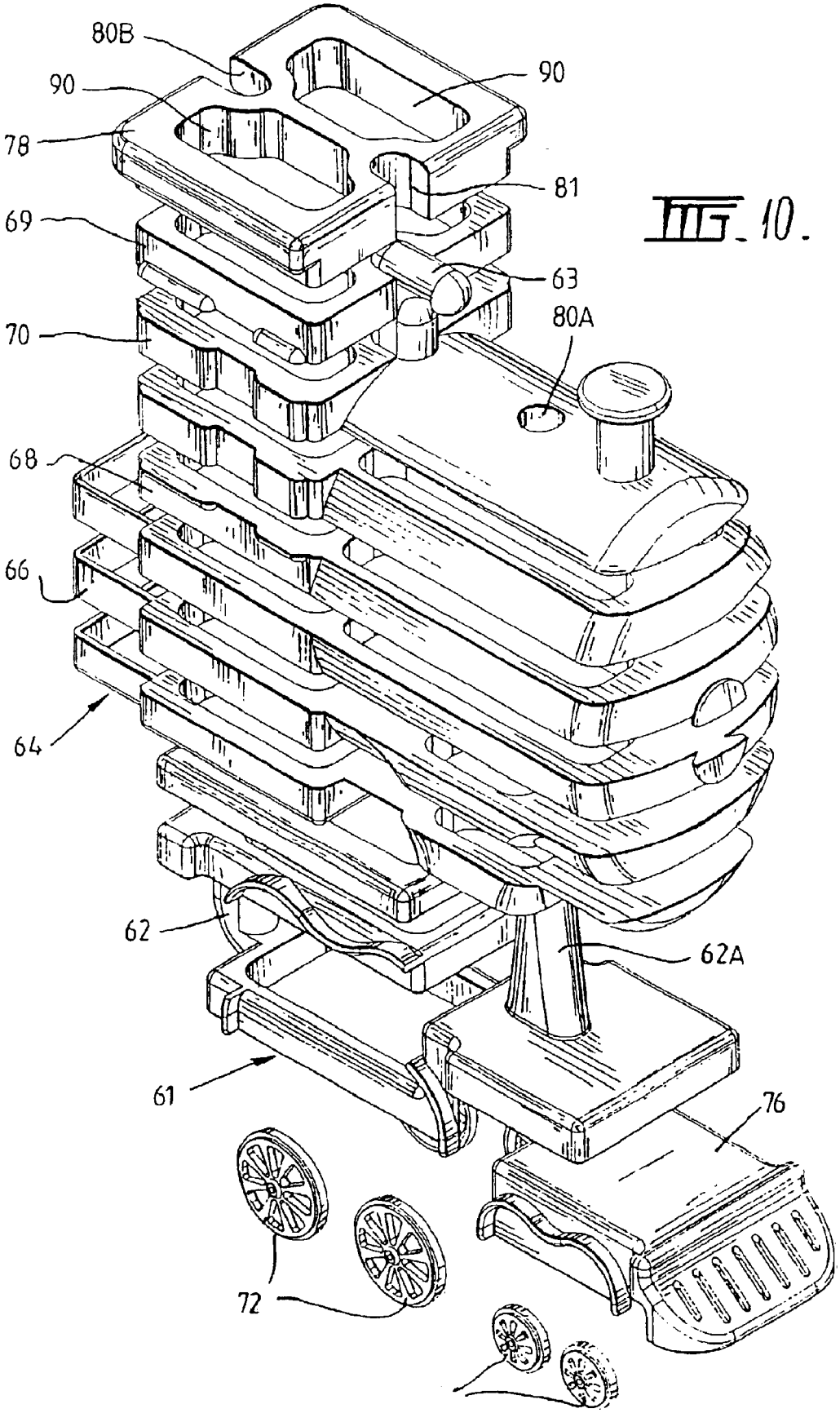
FIG. 10 is an upper perspective view of the toy of FIG. 1 in partly assembled form.
Figure 11:
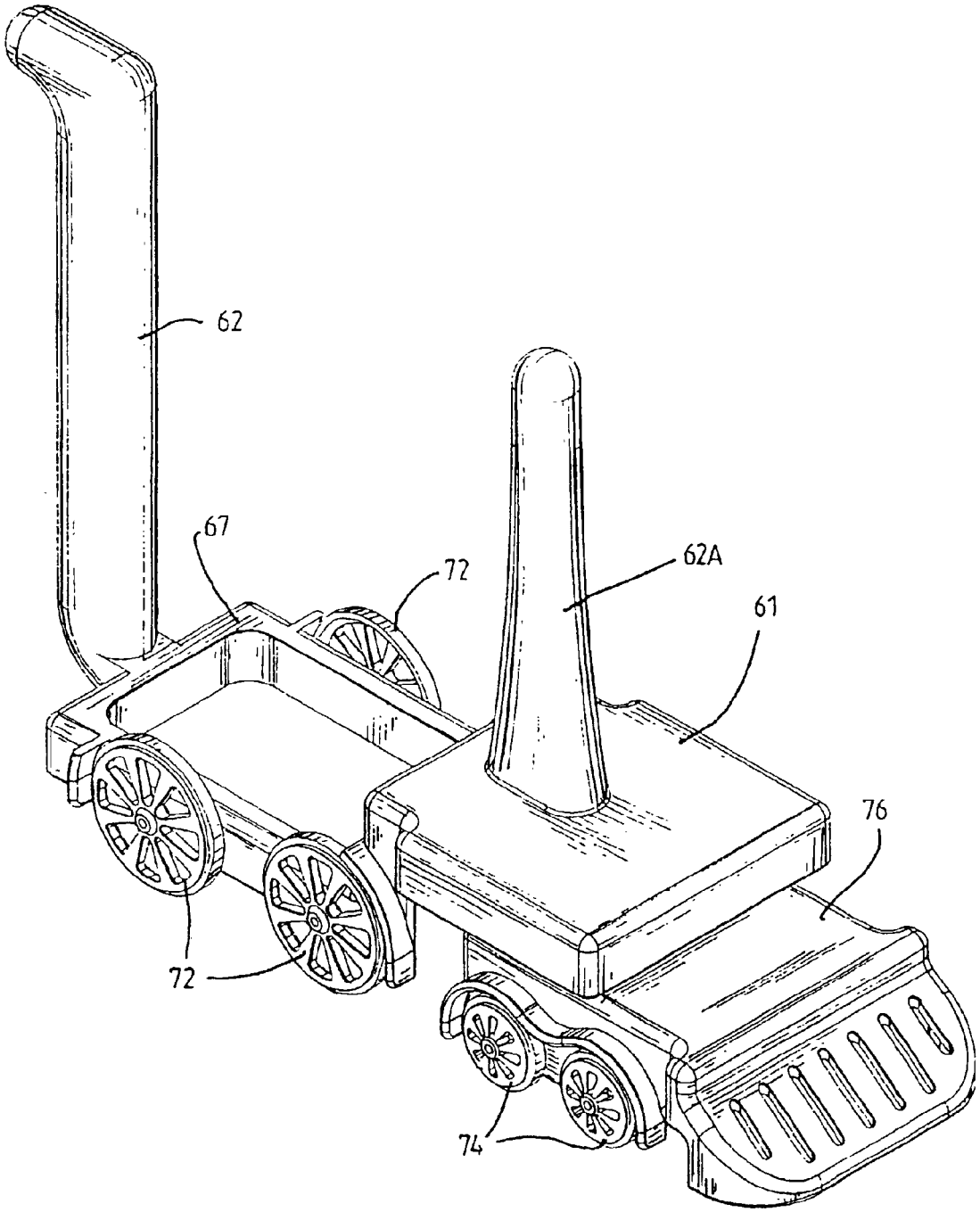
FIG. 11 is an upper perspective view of an interconnection member of the toy of FIG. 9.

Referring to FIGS. 10 and 11, it can be seen that the connecting member 61 is formed of a first portion 65, a second portion 67 and a front bogey portion 76. The first portion 65 has an upwardly projecting tapered pin 62(A). The second portion 67 has another upwardly projecting pin 62(B). The pins 62 provide interconnection of the planar members 64 as shown in FIG. 10. The pin 62A is threaded through holes 80A in each of the planar members 64. The pin 62B is threaded through a cut-out or notch 80B in each of the planar members 64. Thus, when threaded through the pins 62 the planar members 64 are connected together. Due to the tapering shape of pin 62A, the hole 80A is of a corresponding shape so that only when the planar members 64 are assembled in the correct order can be properly be connected together.

Large drive wheels 72 are attached to the second portion 67. Small bogey wheels 74 are attached to the bogey portion 76. Bogey portion 76 projects forwardly from first portion 65.

Planar member 70 includes a further upwardly projecting pin 63 for connecting planar members 69 and 78 together, with pin 62B. Planar members 69 and 78 include a cutout or notch 81 for receiving the pin 63. The pins 62A, 62B and 63 are shaped so that the outer visible ends form part of the idea of the toy train 60.

Figure 12:
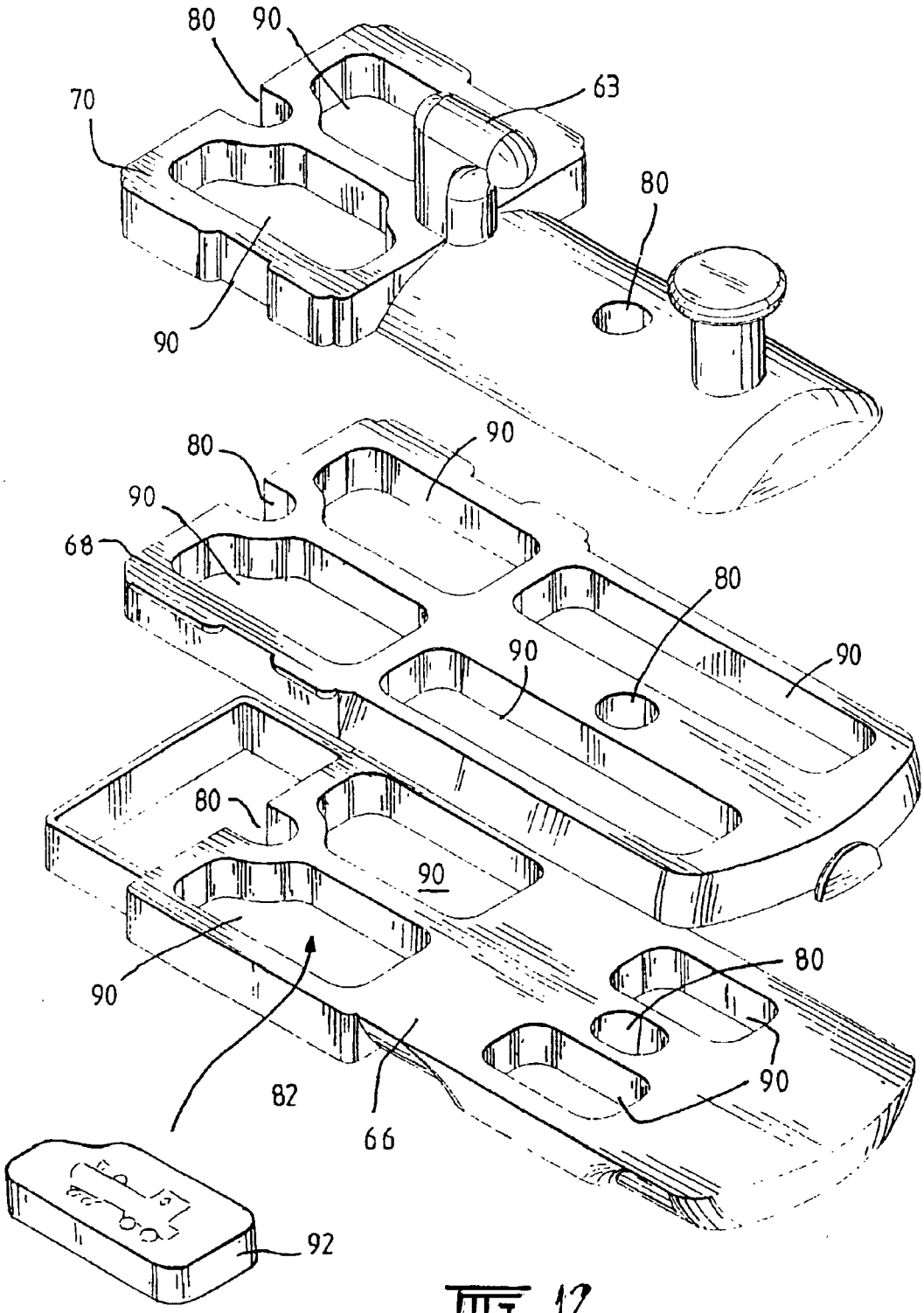
FIG. 12 is an upper perspective view of a plurality of planar members used to form the toy, and a plurality of voids with one void having an element ready for positioning in one of the voids.

Referring to FIG. 12, planar members 66, 68 and 70 are shown. These members, as with others of the planar members 64, include voids 90 shaped to receive elements or inserts. In this case, the inserts may have illustrations in the form of people who ride on the train, such as the train driver, engineer, conductor etc., or may be in the form of different types of train from around the world. An insert 92 is shown in FIG. 12 that may be inserted into the void 82 as indicated by the arrow. The insert 92 is tapered in shape so as to fit within the void 82 without passing all the way through. The tapering of the inside of the void 82 is not shown.

Figure 13:
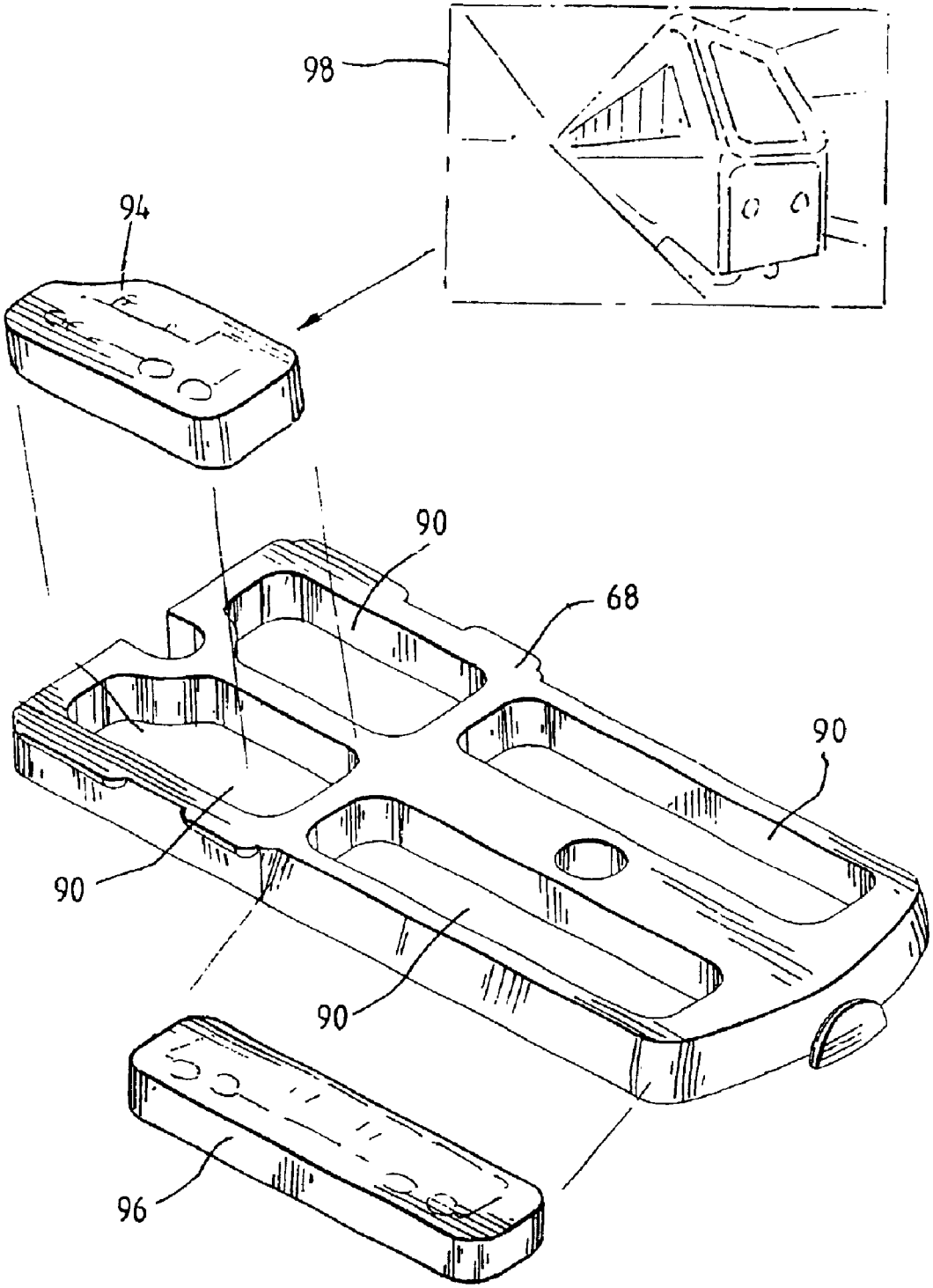
FIG. 13 is a removable schematic representation of a horizontal planar member of FIG. 9 with inserts shown for insertion into voids of a planar member.

FIG. 13 shows a representation of the type of train image 98 that may be placed on an insert 94 for insertion into one of the voids 90 of the planar members 68. Also shown is another insert 96 that may be, for example, a train carriage of the train image 98 that can be inserted into another void 90 of the planar member 68.

Now that an example of the present invention has been described it will be clear to the skilled addressee that it has the following advantages over the prior art. The horizontal and vertical members of the toy can be assembled and disassembled as a boat.

Additionally the animals may be inserted within each of the planar members so that the boat may be assembled with or without the animals present.

It will be apparent to those skilled in the relevant art that, modifications and variations can be made to the present invention without departing from the basic inventive concept. The toy of the present invention need not be an ark and the inserts need not be animal shaped. Many other shapes and toys could be used other than the Noah's ark or steam train concepts. Such other shapes of toy may include a car having a plurality of inserts that may be in the form of passengers or types of car from around the world or different vintages of car. Another example is a truck toy with the inserts being different types of truck, such as a tow truck, a lorry or a semi-trailer. A further example of a toy may be a ship with the inserts being different types of ship, such as a tug boat, a container ship, a battleship, an aircraft carrier, a cruise liner etc. A further example may be a toy in the shape of a human body with the inserts being different organs or body parts such as a heart, brain, lungs, stomach etc. The human body toy may be used to educate children on various parts of the human body. Numerous other concepts of toy can be used according to the present invention.

All such modifications and variations are intended to be within the scope of the present invention. The nature of which it to be determined from the forgoing description.

What is claimed is:

1. A toy comprising:

a plurality of removable members, each member being substantially planar and adapted to be layered with at least one of the other removable members, each removable member being a non-deconstructable unit having a predetermined shape, such that the removable members, when assembled in a predetermined order, form the outer shape of the toy; and a plurality of removable elements, each removable element being of a predetermined shape;

wherein at least two removable members have a plurality of voids, each void being of a corresponding shape to receive one of the removable elements;

wherein each removable element lies in substantially the same plane as its respective removable member when received in the respective removable member;

wherein the toy may be assembled with or without the elements being within their corresponding members.

2. A toy according to claim 1, wherein the removable members form horizontal and/or vertical layers of the assembled toy.

3. A toy according to claim 1, wherein each element only fits in a respective correspondingly shaped void within one of the members.

4. A toy according to claim 1, wherein the toy further includes an interconnection mechanism for holding together the removable members when the toy is assembled.

5. A toy according to claim 4, wherein a first set of the removable members are horizontally layered.

6. A toy according to claim 5, wherein a second set of the removable members are vertically layered.

7. A toy according to claim 6, wherein the toy is in the shape of a boat when assembled, with the first set of members forming a hull.

8. A toy according to claim 7, wherein the second set of the members form a cabin on a deck of the boat.

9. A toy according to claim 7, wherein the interconnecting mechanism forms the keel of the boat.

10. A toy according to claim 1, wherein the elements are tapered and the corresponding shaped void is also tapered so as to receive the element in one direction but not allow it to pass through the member.

11. A toy according to claim 1, wherein each element is in the shape of an animal.

12. A toy according to claim 11, wherein the animals are in pairs.

13. A toy according to claim 4, wherein the interconnection mechanism is in the form of an interconnection member having a projecting portion for holding the removable members in place when the toy is assembled.

14. A toy according to claim 13, wherein the interconnection member forms a base of the toy wherein the removable members are layered on top of the interconnection member.

15. A toy according to claim 1, wherein at least one of the elements is wholly contained within its respective removable member.

16. A toy according to claim 1, wherein at least one of the elements is hidden within the toy when the toy is assembled.

17. A toy according to claim 1, wherein the corresponding shaped void is specifically shaped to receive only the corresponding element.

18. A toy according to claim 1, wherein each of the elements form toy elements adapted for independent play.

19. A toy according to claim 1, wherein the toy is adapted for play as a whole when assembled with or without the elements, the toy is further adapted for play by assembly of the toy with or without the elements, the toy is further adapted for play in parts when assembled without the elements along with the elements external to one assembled toy, and the toy is further adapted for play with the elements alone.

* * * * *